US005086679A

United States Patent [19]

Fletcher

[11] Patent Number: 5,086,679

[45] Date of Patent: Feb. 11, 1992

[54] PROCESS FOR APPARATUS FOR COLLECTING CONTINUOUS SUPPLIED YARN TO WASTE

[75] Inventor: Grant M. Fletcher, Arnprior, Canada

[73] Assignee: BASF Fibres Inc., Arnprior, Canada

[21] Appl. No.: 563,376

[22] Filed: Aug. 6, 1990

Related U.S. Application Data

[63] Continuation of Ser. No. 253,281, Oct. 3, 1988.

[51] Int. Cl.[5] ..... B65H 29/24

[52] U.S. Cl. ..... 83/24; 83/100; 83/402

[58] Field of Search ..... 83/22, 24, 98, 100, 83/402, 950; 226/97; 112/DIG. 1, 287, 285, 295, 298; 30/49, 130, 301, 316

[56] References Cited

U.S. PATENT DOCUMENTS

| | | | |
|---|---|---|---|
| 2,634,491 | 4/1953 | McDermott | 83/24 |
| 3,191,831 | 6/1965 | Bunting, Jr. et al. | 83/100 X |
| 3,241,234 | 3/1966 | Kiefer et al. | 83/100 X |
| 3,564,958 | 2/1971 | Richter | 83/100 |
| 3,570,339 | 3/1971 | Vandersip | 83/24 |
| 3,678,579 | 7/1972 | Slavik . | |
| 3,683,732 | 8/1972 | Juppet | 83/100 |
| 3,808,924 | 5/1974 | Ferguson | 83/100 X |
| 3,857,309 | 12/1974 | Bradley et al. | 83/24 X |
| 3,922,938 | 12/1975 | Hautemant et al. | 83/100 |
| 4,389,774 | 6/1983 | McLaughlin, Jr. | 83/100 X |

*Primary Examiner*—Mark Rosenbaum
*Assistant Examiner*—Eugenia A. Jones

[57] ABSTRACT

Disclosed is a process for accumulating yarn from a continuous supply source to waste and apparatus for cutting the yarn initially and upon preparation for threading the yarn into a continuous process.

5 Claims, 4 Drawing Sheets

A-A

PROCESS FOR APPARATUS FOR COLLECTING CONTINUOUS SUPPLIED YARN TO WASTE

This is a continuation of copending application Ser. No. 07/253,281 filed on 10/3/88.

BACKGROUND OF THE INVENTION

Yarn waste is inevitable in the manufacture of synthetic linear polymeric and other synthetic yarns. By yarns, it is meant bunches of continuous length filaments of 0.5 to 30 denier each.

It is known to gather yarns from continuous processing machines, i.e., machines that have a constant supply of yarn being received—and send the yarns to waste through a pneumatic aspirating device while (a) threading the yarn through the processing machine, (b) capturing the yarn to make a repair or adjustment on the machine, or other operations in which the yarn processing machine cannot accept a yarn being fed continuously to it. The yarn being wasted through an aspirator "gun" is usually transported by the aspirating air to a containment vessel.

Problems have arisen in how to get an aspirating gun to accept running yarn. Quite often, scissors are employed by the operator of the "gun" to snip the yarn to get it started into the "gun" and also to terminate use of the gun at an appropriate time. This obviously requires use of more than one hand and, at times, requires more than one operator.

The present invention is directed to cutting means associated with the aspirating device which greatly assists in capturing and cutting the yarn during operation of the aspiration jet. The invention employs a cutting edge at the entrance to the aspirator.

BRIEF DESCRIPTION OF THE DRAWINGS

Additional embodiments can be ascertained through reference to the following drawings, in which.

DETAILED DESCRIPTION OF THE EMBODIMENT

Figure 1:
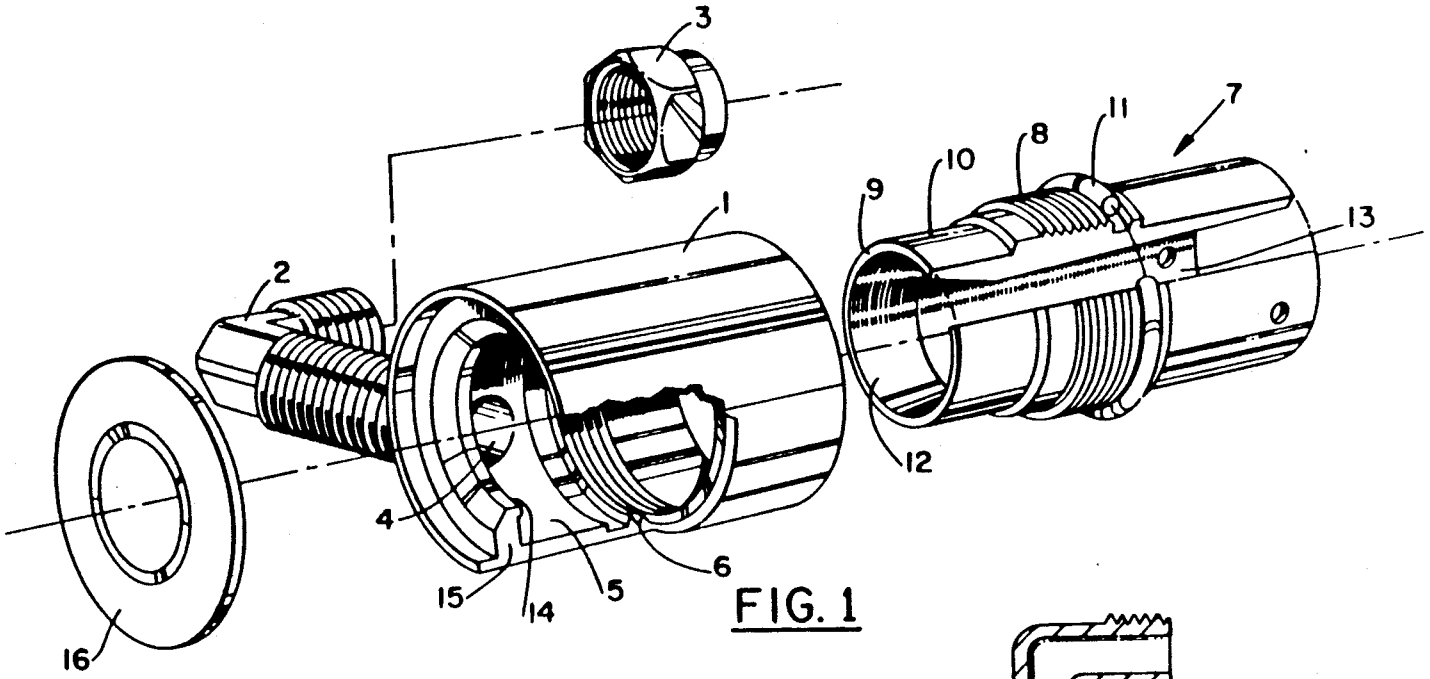
FIG. 1 is an expanded isometric view of one embodiment of the invention showing a circular cutting surface.

In the embodiment of FIG. 1 is depicted an aspirator head 1 having an air supply tubing connector 2 and flange nut 3 for connecting a pressured gas source (not shown) to the aspirator head. The aspirator head 1 has an inner lip 15 and channel surface 5 which combine with surfaces 9 and 10 and plenum surface 12 of aspirator body 7 to form a semiclosed chamber for receiving the pressured gas. In operation, pressured gas entering the chamber thus formed escapes through the small space left between lip 15 and surface 9 and is directed toward the entrance plenum 12 by tip 14 on aspirator lip 15. The pressured gas continues to expand into exhaust plenum 13. The rearward directioning of gas by tip 14 creates a vacuum condition at inner lip 15, drawing air and filaments placed near the entrance of the head 1 into the body of the head.

In this embodiment, the inner lip 15 also provides a stop for a yarn cutter disc 16. Cutter disc 16 may be positioned against the stop 15 in any conventional manner, including friction fitting as shown in FIG. 1.

Figure 1A:
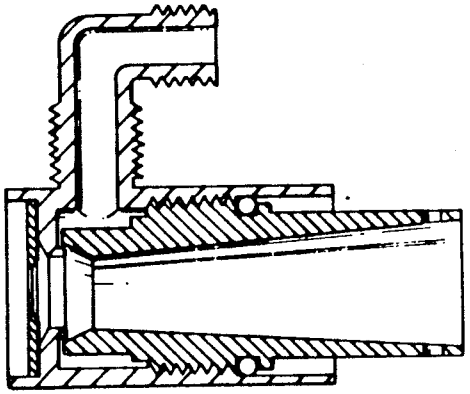
FIG. 1A is a cross-sectional view of the assembly of the embodiment of FIG. 1.

The positioning of aspirator body 7 within head 1 may be adjusted through action of outer or male threads 8 on body 7 and inner or female threads 6 in head 1. The relative positioning of these two bodies adjusts the aspiratory force of the jet formed thereby. An "O" ring 11 may be used to seal the jet, if desired. FIG. 1A shows the assembly of the head 1 and body 7 in operative position, with the cutter disc 16 positioned adjacent and totally within the inlet of the assembly.

Figure 2:
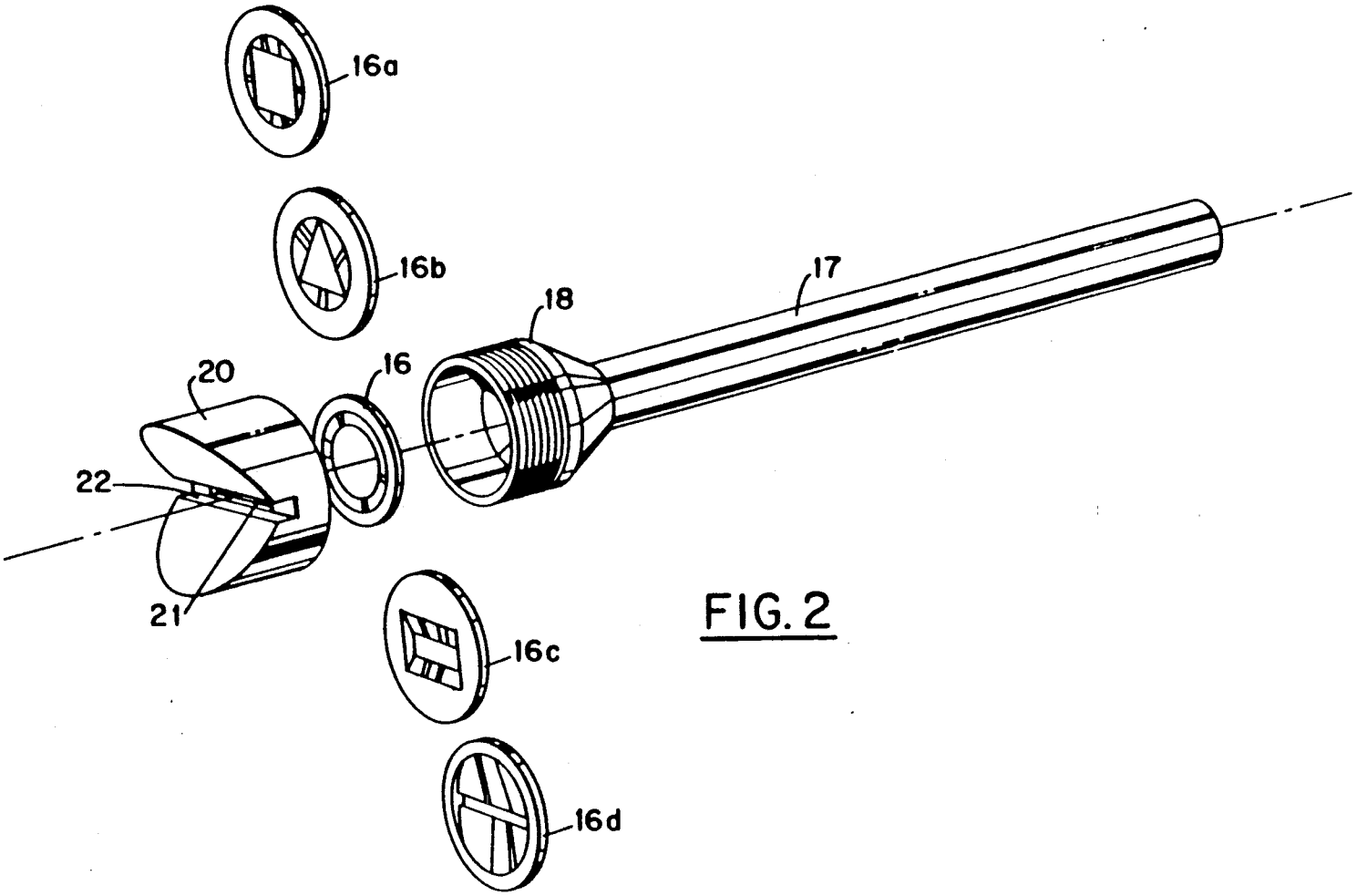
FIG. 2 is an alternative embodiment in which the cutting surface is extended from the aspirator by a tube.

FIG. 2 represents an embodiment in which the aspirator (not shown) and cutting head are separated by an extension tube 17. Tube 17 has an alternate means for holding the cutting disc in place, i.e., an enlarged head 18 having outer threads, the outer diameter of the head being slightly larger than the cutting disc. A cutter guard having inner threads (See FIG. 4) positions the cutting disc relative to the extension tube. A guiding channel 22 directs yarns in the vicinity of slit 21 in the guard 20, pulling yarns through the slit and into contact with disc 16.

Figures 3, 3A, 3B, 4, 4A:
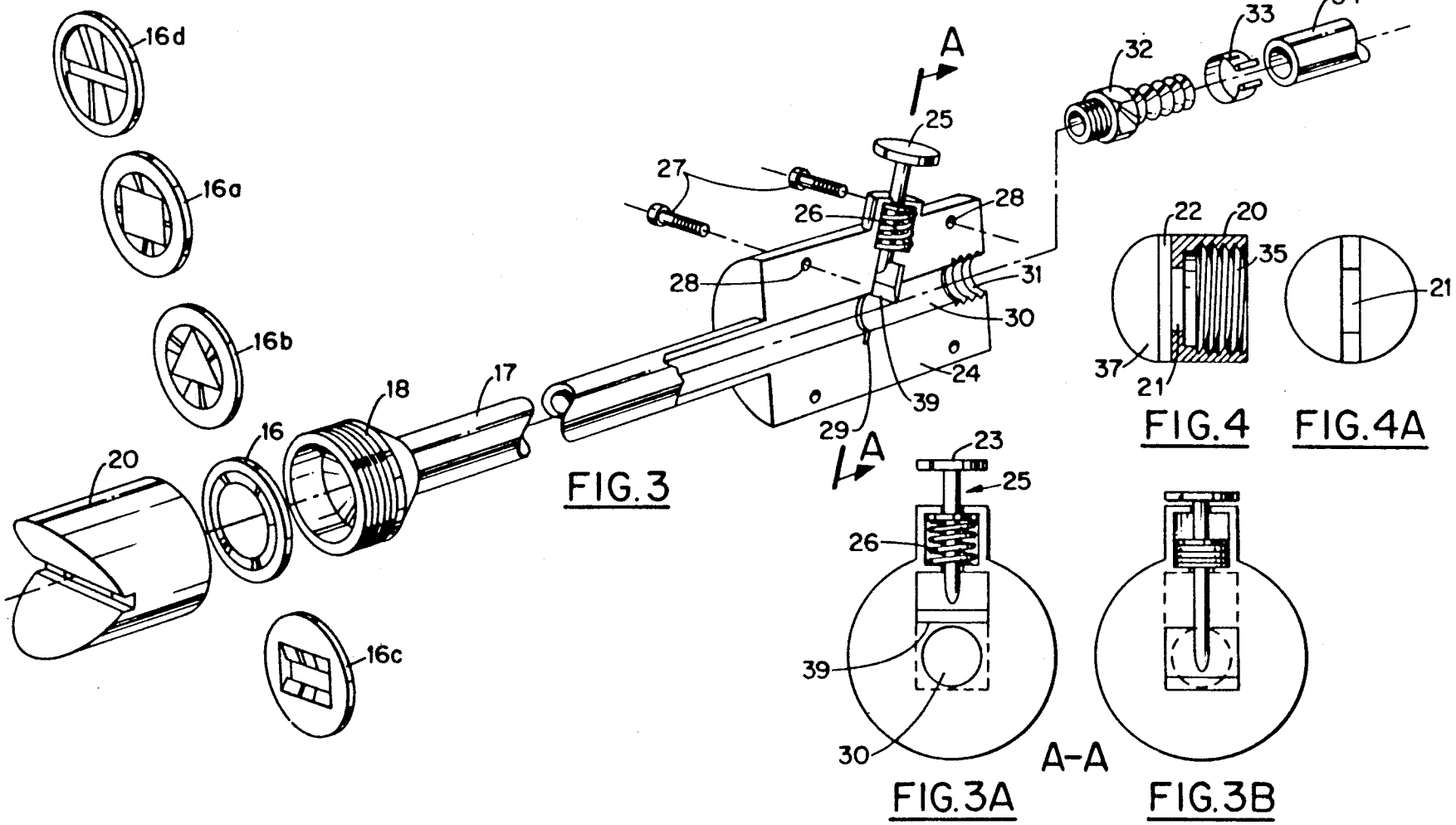
FIG. 3, 3A, and 3B depict the alternative embodiment of FIG. 2 with alternative primary and secondary cutting surfaces.
FIGS. 4 and 4A detail a cutter guard embodiment.

A number of variations of cutter disc 16 are shown in FIGS. 2 and 3. In disc 16, the inner surface of the annular shaped disc is formed into a cutting edge. Disc 16 can be rotated slightly during operation, as the edge dulls, to expose a sharpened surface to yarns entering slot 22. The rectangular surface of disc **16*a* is rotated 90° to expose a sharpened surface; disc 16*b*, 120°; and disc 16*c* and 16*d***, 180°.

In FIG. 3, an embodiment depicting a secondary cutter in conjunction with the extension tube 17 exhibits an especially effective manner of cutting threads or filaments of yarns in a continuous process. In this embodiment, a secondary cutter body half 24 is shown; an identical mating half is not shown. The mating half and body half 24 are joined together through the use of bolts 27 through mounting holes 28.

Yarn channel 30 is connected to an aspirator jet (not shown) through tubing adapter 32 clamped to hose 34 by clamp 33.

A spring operated cutter 25 having a push head 23 is positioned in slit 29 at angle to the yarn channel 30. When not being operated, spring 26 holds the secondary cutter edge 39 clear of channel 30 (see FIG. 3A). When push head 23 is pressed downward against spring 26, the cutting edge 39 closes off channel 30 (see FIG. 3B).

Figure 5A:
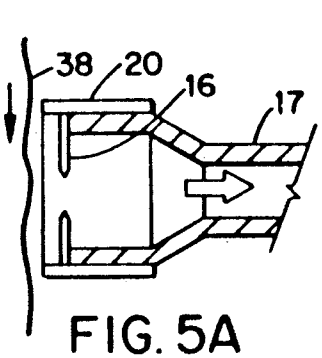
FIGS. 5A–5E show a yarn cutting procedure utilizing the apparatus of FIG. 3.
Figure 5B:
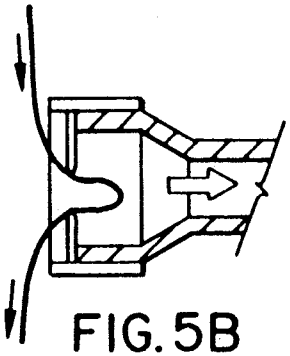
Figure 5C:
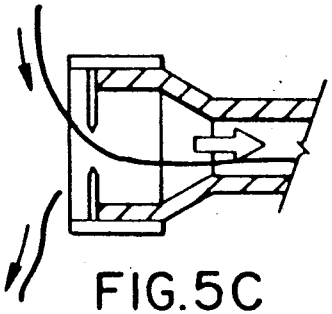

The operation of the embodiment of FIG. 3 can be seen by referring to the cutting steps depicted in FIGS. 5A through 5C. A yarn 38 from a continuous source is placed adjacent the entrance of cutter guard 20 (channel 22 in FIG. 4). The suction force from the aspirator or other vacuum source draws the yarn 38 through slit 21 (see FIG. 4) and into contact with the cutting edge of disc 16 as shown in FIG. 5B.

Figure 5D:
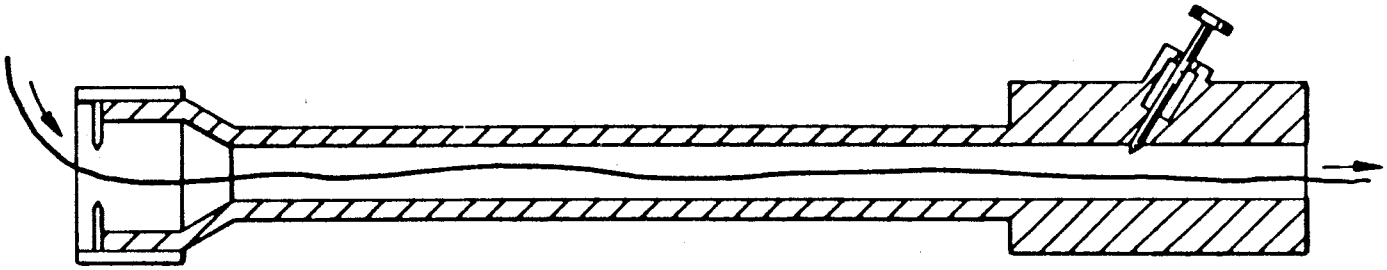
Figure 5E:
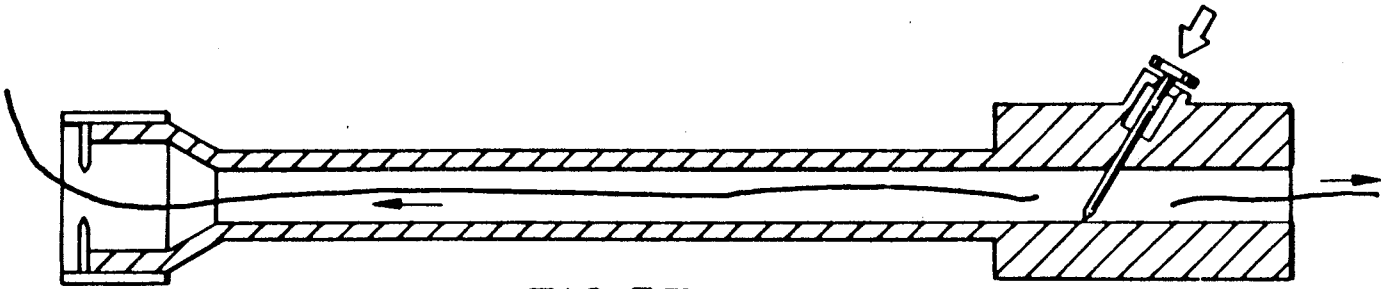

A pulling force on the yarn 38, as from a winding device, driven roll, or other such source drags the yarn 38 across the cutting edge of disc 16, thereby severing the individual filaments of the yarn (FIG. 5C). The loose end from the continuous source continues to be drawn into the extension tube 17 (FIG. 5D). The yarn 38 is thus deflected to waste until appropriate adjustment has been made to the processing machine. During this process, several feet to several hundred yards of yarn may be wasted.

When the yarn 38 can be rethreaded through the processing machine, push button head 23 is pushed downward, cutting the yarn and blocking the vacuum force pulling the yarn. The end 38 of the yarn can then be easily removed from the aspirator and processed further as desired.

The invention herein has several embodiments which become immediately apparent to those skilled in the art. It may be mounted stationary on the processing machine or be part of a wand movable from point to point on the processing machine. Its materials of construction are conventional.

What is claimed is:

1. A process for aspirating a continuously supplied yarn to waste, comprising:

(a) moving the yarn adjacent an aspiring device having an entrance for receiving yarn, said device having a stationary inner annular cutting edge substantially surrounding the entrance;

(b) aspirating a loop of the yarn into the entrance of the device and tensioning the loop across the inner annular cutting edge to cut the yarn;

(c) continuing to aspirate the cut continuously supplied yarn to waste; and (d) simultaneously cutting the yarn downstream of said annular cutting edge and blocking the action of the aspirating device, thereby releasing the yarn for further processing.

2. In a yarn aspirating device having an inlet for receiving yarn: stationary severing means positioned totally within the inlet for severing yarn momentarily pulled into the inlet, said severing means including an annular disc defining a disc diameter and having an inner surface forming a cutting edge; a cylindrical aspirator head, said head having a flange, said flange having an inner lip formed in one end and inner threads in the other end; a cylindrical body having outer threads to mate with said inner threads, one end surface of said body forming with the flange and inner lip a concentrating channel for forcing a gas under pressure in one direction through the center of said body, said disc being mounted in said head adjacent said flange opposite the direction of said forced gas; and means for supplying said gas under pressure to said concentrating channel.

3. In a yarn aspirating device having an inlet for receiving yarn: stationary severing means positioned totally within the inlet for severing yarn momentarily pulled into the inlet, said severing means including an annular disc defining a disc diameter and having an inner surface forming a cutting edge; a tubing of determined length and inner diameter having a vacuum source attached to one end; a threaded end having an end surface of an outer surface diameter larger than the disc diameter and an inner surface diameter smaller than the disc diameter, but larger than the cutting edge; and a guard means having inner threads to mate with the threaded end of the tube and an inner slit in one end, whereby yarn passing adjacent said slit will be drawn into the slit by the vacuum from the source and cut by the cutting edge.

4. The yarn aspirator device of claim 3, including secondary means for simultaneously cutting the yarn and temporarily blocking the vacuum source.

5. The yarn aspirator device of claim 4, said secondary means including blade cutting means extendable across the tubing and spring means for moving said blade cutting means out of the inner diameter of the tubing.

* * * * *

UNITED STATES PATENT AND TRADEMARK OFFICE

CERTIFICATE OF CORRECTION

PATENT NO. : 5,086,679

DATED : February 11, 1992

INVENTOR(S) : Grant M. Fletcher

It is certified that error appears in the above-identified patent and that said Letters Patent is hereby corrected as shown below:

In the title of the invention, delete the first occurrence of "FOR" and put "AND" in its place.

At column 1, line 2, delete the first occurrence of "FOR" and put "AND" in its place.

Signed and Sealed this

Sixth Day of April, 1993

*Attest:*

STEPHEN G. KUNIN

*Attesting Officer*

*Acting Commissioner of Patents and Trademarks*